US006079697A

United States Patent [19]

Tuggle et al.

[11] Patent Number: 6,079,697

[45] Date of Patent: Jun. 27, 2000

[54] METHOD AND APPARATUS FOR FAST START FUEL SYSTEM FOR AN INTERNAL COMBUSTION ENGINE

[75] Inventors: Lloyd H. Tuggle; Imack L. Collins; Jeffrey G. Sadler, all of Shreveport; Michael J. Ferlito, Bossier City, all of La.

[73] Assignee: WCI Outdoor Products, Inc., Cleveland, Ohio

[21] Appl. No.: 09/244,522

[22] Filed: Feb. 4, 1999

Related U.S. Application Data

[63] Continuation of application No. 08/914,551, Aug. 19, 1997, Pat. No. 5,891,369, which is a continuation of application No. 08/593,084, Jan. 29, 1996, abandoned.

[51] Int. Cl.[7] ..... F02M 1/16; F02M 17/04

[52] U.S. Cl. ..... 261/35; 261/52; 261/DIG. 8; 261/DIG. 68

[58] Field of Search ..... 261/35, 52, DIG. 8, 261/DIG. 68

[56] References Cited

U.S. PATENT DOCUMENTS

| | | | |
|---|---|---|---|
| 1,033,886 | 7/1912 | Gentle | 261/DIG. 8 |
| 1,325,126 | 12/1919 | Thompson | 261/DIG. 8 |
| 1,376,343 | 4/1921 | Lamb | 261/DIG. 8 |
| 1,536,810 | 5/1925 | Reddig | 261/DIG. 8 |
| 2,597,776 | 5/1952 | Chandler | 123/179.7 |
| 3,093,699 | 6/1963 | Demitz | 261/52 |
| 3,275,305 | 9/1966 | Nutten | 261/DIG. 8 |
| 3,315,949 | 4/1967 | Sutton | 261/39.3 |
| 3,319,943 | 5/1967 | Morgan | 261/39.3 |
| 3,371,658 | 3/1968 | Turner | 261/DIG. 8 |
| 3,451,383 | 6/1969 | Nelson | 261/DIG. 8 |
| 3,494,343 | 2/1970 | Nutten | 261/DIG. 8 |
| 3,620,424 | 11/1971 | Grigsby | 222/450 |
| 3,805,758 | 4/1974 | May | 261/DIG. 8 |
| 3,948,589 | 4/1976 | DuBois | 417/487 |
| 4,204,489 | 5/1980 | Onishi | 123/73 A |
| 4,271,093 | 6/1981 | Kobayashi | 261/35 |
| 4,335,061 | 6/1982 | Kobayashi | 261/35 |
| 4,427,604 | 1/1984 | Pawelski | 261/DIG. 8 |
| 4,447,370 | 5/1984 | Kobayashi et al. | 261/35 |
| 4,462,346 | 7/1984 | Haman et al. | 123/73 A |
| 4,508,068 | 4/1985 | Tuggle et al. | 261/DIG. 73 |
| 4,509,471 | 4/1985 | Eberline et al. | 123/179.16 |
| 4,554,896 | 11/1985 | Sougawa | 261/DIG. 8 |
| 4,589,386 | 5/1986 | Everts | 261/DIG. 8 |
| 4,769,185 | 9/1988 | Nagasaka et al. | 261/35 |
| 4,787,356 | 11/1988 | Rosgen et al. | 261/69.2 X |
| 4,793,951 | 12/1988 | Scott | 261/DIG. 8 |

(List continued on next page.)

FOREIGN PATENT DOCUMENTS

| | | | |
|---|---|---|---|
| 0 036 608 | 9/1981 | European Pat. Off. . | |
| 0 331 732 | 9/1989 | European Pat. Off. . | |
| 59 054758 | 3/1984 | Japan . | |
| 0194067 | 11/1984 | Japan | 261/DIG. 8 |
| 63 138148 | 6/1986 | Japan . | |
| 01 177442 | 7/1989 | Japan . | |
| 324255 | 10/1991 | Japan | 261/DIG. 8 |
| 2 110 761 | 6/1983 | United Kingdom . | |
| 2 169 352 | 6/1986 | United Kingdom . | |

OTHER PUBLICATIONS

*Applicants' Parent Case.

*Primary Examiner*—Richard L. Chiesa
*Attorney, Agent, or Firm*—Pearne & Gordon LLP

[57] ABSTRACT

A fuel delivery system for an internal combustion engine. The fuel delivery system includes a carburetor housing having an air passage with a throttle valve disposed therein. A choke lever is movably mounted to the carburetor housing for restricting air flow into the air passage. A fuel injection device is provided for injecting fuel into the air passage before the engine is started. Movement of the choke lever to an engaged position simultaneously opens the throttle valve, restricts air flow into the air passage and activates the fuel injection device to inject a predetermined volume of fuel into the air passage. The air-flow restriction and the predetermined volume of fuel are adjusted to compensate for changes in ambient temperature.

14 Claims, 9 Drawing Sheets

U.S. PATENT DOCUMENTS

| | | | |
|---|---|---|---|
| 4,814,114 | 3/1989 | Charmley | 261/35 |
| 4,862,847 | 9/1989 | Kobayashi et al. | 261/DIG. 8 |
| 4,877,560 | 10/1989 | Kenny et al. | 261/35 |
| 4,893,593 | 1/1990 | Sejimo et al. | 261/DIG. 8 |
| 4,905,641 | 3/1990 | Miller | 123/179.13 |
| 4,936,267 | 6/1990 | Gerhardy et al. | 261/DIG. 68 |
| 5,063,891 | 11/1991 | Noisier | 261/DIG. 8 |
| 5,073,307 | 12/1991 | Langer et al. | 261/35 |
| 5,273,008 | 12/1993 | Ditter | 261/DIG. 8 |
| 5,554,322 | 9/1996 | Kobayashi | 261/DIG. 8 |
| 5,891,369 | 4/1999 | Tuggle et al. | 261/35 |

206

210
204
202
205
20
203
10
212
30
172
193
119
109
192
110
108
140
120
112
115

METHOD AND APPARATUS FOR FAST START FUEL SYSTEM FOR AN INTERNAL COMBUSTION ENGINE

CROSS-REFERENCE TO RELATED APPLICATION

This is a continuation of application Ser. No. 08/914,551, filed Aug. 19, 1997, now U.S. Pat. No. 5,891,369 which is a continuation of application Ser. No. 08/593,084, filed Jan. 29, 1996, which is now abandoned.

BACKGROUND OF THE INVENTION

The present invention is directed to a fuel delivery system for an internal combustion engine, and more particularly to a method and apparatus for improving the cold starting characteristics of an internal combustion engine having a diaphragm carburetor.

Hand held power devices such as chainsaws, hedge trimmers, line trimmers and edgers are often powered by small internal combustion engines outfitted with diaphragm carburetors. Generally, a diaphragm carburetor has an air passage with a venturi, a diaphragm pump, a needle valve and a metering chamber containing a spring biased diaphragm. The outlet of the air passage leads to the crankcase of the engine. A throttle valve of the butterfly type is typically mounted in the air passage to control the amount of fuel and air entering the crankcase.

Fuel is drawn into the carburetor by the diaphragm pump, which is connected to the metering chamber through the needle valve. The metering chamber, in turn, is connected to the air passage through supply passages fitted with one-way valves. The supply passages open to the air passage through a plurality of outlet ports. The opening and closing of the needle valve and, thus, the flow of fuel into the metering chamber is controlled by a spring biased diaphragm, which is mounted inside the metering chamber.

During normal operation of the engine, pulses of pressure from the engine cause the diaphragm pump to pump fuel from a storage tank up to the needle valve. Subatmospheric air pulses passing through the venturi create a negative pressure in the metering chamber, causing a displacement of the metering chamber diaphragm. The displacement of the diaphragm opens the needle valve and permits fuel to enter the metering chamber. The fuel exits the metering chamber through the outlet ports and enters the air passage where it is atomized. Eventually, the flow of fuel into the metering chamber increases the pressure in the metering chamber, causing the diaphragm to close the needle valve and stop the flow of fuel. As the fuel empties from the metering chamber, the pressure in the metering chamber drops until the diaphragm is again displaced and the needle valve opens. In this manner, the diaphragm in the metering chamber continually opens and closes the needle valve, thereby introducing metered amounts of fuel into the air passage.

Since the delivery of fuel in a diaphragm carburetor is not dependent upon gravity, the operation of a diaphragm carburetor is not affected by its spatial orientation. Accordingly, diaphragm carburetors are ideally suited for use in power devices such as chainsaws that may be held by an operator in a variety of positions. Engines utilizing diaphragm carburetors, however, tend to be difficult to start after a period of non-use because of an initial absence of fuel in the metering chamber and the diaphragm pump. Air choke mechanisms are utilized to remedy this situation. However, most air choke mechanisms are unable to quickly and efficiently establish a proper air to fuel ratio and can flood the engine by introducing excess fuel into the engine.

Air choke mechanisms are usually comprised of slide valves or butterfly valves. Typically, a butterfly valve will be rotatably mounted inside the air passage near the inlet. The butterfly valve often has a small orifice passing therethrough. Usually, the butterfly valve can be rotated between three different positions: an open position, a half-choke position and a full choke position. When the butterfly valve is in the open position, the inlet to the air passage is substantially open. In the half-choke position, the butterfly valve is partially closed and, thus, partially blocks the inlet to the air passage. In the full-choke position, the butterfly valve is closed and blocks the inlet to the air passage except for the small orifice. When the engine is cranked during starting, by a pull rope or otherwise, air is drawn out of the air passage and into the engine. If the choke mechanism is in a full-choke position or a half-choke position, the withdrawal of air creates a negative pressure condition in the air passage. Of course, the amount of pressure reduction is greater in the full-choke position than in the half-choke position. The negative pressure in the air passage creates a negative pressure in the metering chamber which displaces the diaphragm and allows fuel to enter the metering chamber and thence the air passage, where it mixes with air to create an air/fuel mixture.

During the initial cranking cycle, the choke mechanism is placed in a full-choke position to create a maximum vacuum in the air passage. In addition, the throttle valve is fully opened to permit the maximum vacuum to be applied to the outlet ports so as to create a maximum fuel draw. The opening of the throttle valve also permits a maximum amount of the air/fuel mixture to reach the crankcase of the engine. In the full-choke position, however, the air/fuel mixture is very fuel-rich since only a small quantity of air can enter the air passage through the choke mechanism. As the engine begins to fire, more air is required to provide an adequate air/fuel ratio to keep the engine running. Accordingly, the choke mechanism must be moved to the half-choke position as soon as the first internal explosion, or "pop" occurs in the engine. If the choke mechanism is left in the full-choke position for too many cranking cycles after the "pop" occurs, the engine will become flooded with fuel and will not start. The engine will have to be allowed to rest long enough to permit the excess fuel in the crankcase and/or the combustion chamber to evaporate and a proper fuel-air mixture to be restored.

In the half-choke position, the choke mechanism increases the air content in the air/fuel mixture, but still provides a rich-running condition required by the engine during warm-up. After the engine has been running for a few seconds, the choke mechanism must be moved from the half-choke position to the open position to provide a correct air/fuel ratio.

As can be appreciated, the foregoing starting procedure is cumbersome and requires a skilled operator. Accordingly, a variety of priming systems have been developed to help improve the starting characteristics of internal combustion engines with diaphragm carburetors. The object of these priming systems is to introduce fuel into the air passage as soon as the engine cranking cycles are started. One example of a priming system is the air purge system disclosed in U.S. Pat. No. 4,271,093 to Kobayashi, incorporated herein by reference. In Kobayashi, a manually operable resilient pressure dome is connected to the metering chamber and an opening to the atmosphere. When the pressure dome is repeatedly depressed, air from the metering chamber is pulled into the pressure dome and expelled through the atmospheric opening, thereby creating a subatmospheric pressure in the metering chamber. The negative pressure opens the needle valve, partially filling the metering chamber with fuel. When the engine cranking cycles begin, the fuel in the metering chamber is pulled into the air passage through the outlet ports. The amount of fuel in the metering chamber, however, is often insufficient to start the engine, necessitating further engine cranking cycles with the air choke mechanism at a full-choke position. Thus, the Kobayashi system does not eliminate the full-choke and half-choke starting procedure.

In a priming system disclosed in U.S. Pat. No. 4,936,267 to Gerhardy, incorporated herein by reference, the diaphragm in the metering chamber is mechanically deflected by a push rod prior to starting. A positioning lever is connected to both the push rod and a throttle valve. Prior to starting, the positioning lever is pivoted so as to simultaneously move the throttle and depress the push rod. The depression of the push rod deflects the diaphragm and opens the needle valve, permitting fuel to enter the metering chamber. The fuel exits the metering chamber through channels that open into the air passage. Since fuel continues to flow into the metering chamber and air passage until the push rod is manually released, the Gerhardy system is conducive to flooding.

In U.S. Pat. No. 4,508,068 to Tuggle, incorporated herein by reference, a priming system is disclosed wherein fuel is injected directly into the air passage. In addition to a metering chamber, the Tuggle system has a reservoir chamber with a flexible diaphragm wall. The reservoir chamber has an inlet connected to a fuel line leading to a fuel tank with a manually operated plunger pump. An outlet in the reservoir chamber is connected to a flow restricting orifice that opens into an intake manifold portion of the engine downstream of the air passage and the throttling valve. When the plunger pump is depressed, fuel is drawn from the fuel tank and pumped into the reservoir chamber through the fuel line. When the engine cranking cycles begin, the fuel in the reservoir chamber is pulled into the manifold through the restricting orifice. This operation of the Tuggle system is also conducive to flooding because the plunger pump can be depressed too many times, forcing an excessive amount of fuel out of the reservoir chamber and into the manifold.

In U.S. Pat. No. 4,893,593 to Sejimo et al, incorporated herein by reference, a direct fuel introduction system is disclosed for an internal combustion engine having an electric starter motor. In addition to having a metering chamber and other conventional diaphragm carburetor components, the Sejimo system includes a primer pump coupled to the electric starter motor, a fuel reservoir and a fuel metering device, which is separate and distinct from the metering chamber. Before the engine is started, the starter motor and, thus, the primer pump are placed into reverse. When the primer pump is reversed, a negative pressure is created in the metering chamber, causing the needle valve to open and emit fuel into the metering chamber. Fuel exits the metering chamber, fills part of the fuel metering device and then continues into the fuel reservoir. When the starter motor and, thus, the primer pump are placed into forward during starting, the primer pump draws fuel from the fuel reservoir and pumps it into the filled chamber of the metering device, causing the fuel contained therein to be ejected into the air passage.

As can be appreciated, the foregoing prior art priming systems have various drawbacks. The Kobayashi system does not eliminate the need for a full-choke/half-choke starting procedure. The Tuggle system and the Gerhardy system are conducive to over-priming, which can lead to engine flooding. The Sejimo system can only be used with engines having electric starters. Accordingly, there is a need in the art for a fuel delivery system that can quickly start an internal combustion engine without requiring the use of an electric starter motor and without being susceptible to over-priming. In addition, and more specifically, there is a need in the art for a carburetor that can quickly start an internal combustion engine without being susceptible to over-priming and without requiring an electric starter motor. There is also a need in the art to have a method for preparing an internal combustion engine for starting and a method for starting an internal combustion engine that do not require the use of an electric starter motor and are not susceptible to over-priming. The present invention is directed to such a system and to such a carburetor and to such methods.

SUMMARY OF THE INVENTION

It therefore would be desirable, and is an object of the present invention, to provide a fuel delivery system that can quickly start an internal combustion engine without requiring the use of an electric starter motor and without being susceptible to over-priming. In accordance with the present invention, a carburetor is provided having a housing, a fuel pump, and a fuel delivery device. The housing defines an air passage through which air flows toward the engine. The fuel supply circuit has orifices that open into the air passage. A fuel delivery device is connected to the fuel supply circuit and defines a fuel chamber for receiving fuel from the fuel pump. The fuel delivery device is operable in response to air flow through the air passage to deliver fuel from the fuel chamber to the air passage through the fuel supply circuit. A fuel injection device is connected to the fuel supply circuit. The fuel injection device includes a movable member which at least partially defines an injection chamber for receiving fuel. The movable member is movable from a first position to a second position to eject fuel from the injection chamber into the air passage through the fuel supply circuit.

Also provided in accordance with the present invention is a fuel delivery system having a housing and a metering device. The housing defines an air passage through which air is drawn when the engine is running. The air passage has an inlet and an outlet. The outlet is in communication with the engine. The metering device includes a flexible diaphragm, which at least partially defines a metering chamber. A fuel valve is provided for supplying fuel to the metering chamber in response to a negative pressure in the metering chamber. A fuel supply circuit is connected to the metering device and has orifices that open into the air passage. A purging device is provided for creating the negative pressure in the metering chamber when the engine is inactive so as to provide fuel to the metering chamber. A fuel injection device is connected between the metering device and the purging device. The fuel injection device has a movable member and an opposing wall which cooperate to define an injection chamber. Movement of the movable member toward the opposing wall ejects a predetermined volume of fuel from the injection chamber, thereby injecting fuel into the air passage.

It is also desirable, and is also an object of the present invention, to provide a method for preparing an internal combustion engine for starting without overpriming and without requiring the use of an electric starter motor. The engine has a carburetor including a fuel injection device defining an injection chamber and an air passage connected to a metering chamber by a fuel supply circuit. The air passage has a throttle valve disposed therein. In accordance with the present invention, fuel is introduced into the metering chamber, and air flow through the air passage is restricted. Fuel is introduced into the injection chamber from the metering chamber so as to fill the injection chamber with a predetermined volume of fuel. The predetermined volume of fuel is ejected from the injection chamber into the air passage through the fuel supply circuit.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
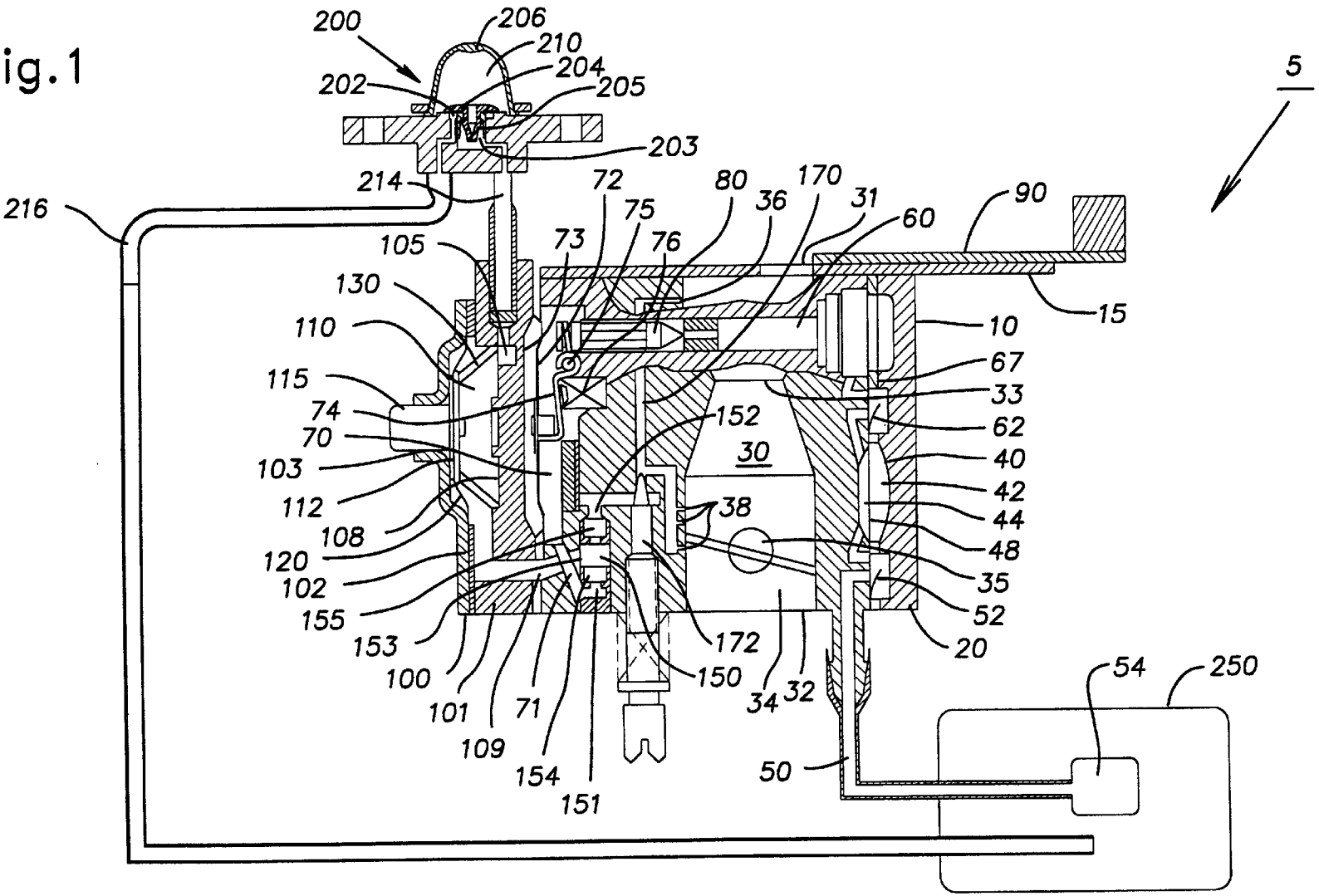
FIG. 1 shows a schematic view of a fuel system according to a first embodiment of the present invention.

It should be noted that in the detailed description which follows, identical components have the same reference numerals, regardless whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a fuel system 5 according to a first embodiment of the present invention. The fuel system 5 generally includes a carburetor 10, a choke lever 90, an air purging device 200 and a fuel tank 250. The carburetor 10 is mounted to a small internal combustion engine (not shown) for use in a portable hand-held device such as a blower, chainsaw, hedge trimmer, line trimmer or edger. The carburetor 10 generally includes a mounting plate 15, a carburetor housing 20, an air passage 30, a diaphragm fuel pump 40, a needle valve 80 and a fuel injection or transfer device 100.

The air passage 30 has an inlet 31 and an outlet 32 leading to the crankcase (not shown) of the internal combustion engine. Downstream of the inlet 31, the air passage 30 narrows into a restriction 33. After the restriction 33, the air passage 30 expands into a throttle bore 34. A conventional butterfly type throttle valve 35 is rotatably mounted inside the throttle bore 34. The flow of air and atomized fuel through the air passage 30 is controlled by the throttle valve 35. The amount of air entering the inlet 31, however, is controlled by the choke lever 90 (shown in more detail in FIGS. 2 and 3) which is rotatably mounted to the carburetor housing 20. As will be described in more detail later, the choke lever 90 can be rotated from a disengaged position wherein the choke lever 90 is positioned away from the inlet 31 to an engaged position wherein the choke lever 90 is positioned over the inlet 31.

The diaphragm fuel pump 40 is defined by a cavity in the carburetor housing 20 that is divided into first and second chambers 42 and 44 by a flexible diaphragm pumping element 48. A main fuel supply line 50 fitted with a one-way flapper valve 52 and a filter 54 connects the second chamber 44 to the fuel tank 250. An outlet fuel line 60 fitted with a one-way flapper valve 62 leads from the second chamber 44 to the inlet of the needle valve 80. When the engine is running, engine pressure pulses from the crankcase (not shown) are transmitted through a passage 67 to the first chamber 42, causing the diaphragm pumping element 48 to move back and forth. The movement of the diaphragm pumping element 48 draws fuel from the fuel tank 250 into the second chamber 44 and pumps it through the outlet fuel line 60 to the inlet of the needle valve 80.

The outlet of the needle valve 80 leads into a metering chamber 70 which is a cavity in the carburetor housing 20 that is delimited on one side by a flexible metering diaphragm 72 adjacent to a first surface 73. The periphery of the metering diaphragm 72 are secured to the carburetor housing 20 while the center of the metering diaphragm 72 is engaged by a first end of a lever 74. A second end of the lever 74 is connected to the needle valve 80. The lever 74 is pivotally mounted to a pin 75 adjacent to the second end of the lever 74. A coil spring 76 engages the lever 74 intermediate the first and second ends thereof, and pivotally biases the first end of the lever 74 toward the metering diaphragm 72 and the first surface 73, which tends to close the needle valve 80. When the metering diaphragm 72 is deflected away from the first surface 73, the lever 74 pivots about the pin 75 and pulls or unseats the needle valve 80, allowing fuel to enter the metering chamber 70.

Fuel exits the metering chamber 70 through an exit section 71 that is connected to a first opening 151 in a valve passage 150. The valve passage 150 also has second and third openings 152, 153 that respectively lead to a fuel supply circuit 170 and the transfer device 100. The first opening 151 is fitted with a one-way valve 154 that permits fuel to flow out of the metering chamber 70 while preventing fuel in the valve passage 150 from flowing into the metering chamber 70. The second opening 152 is fitted with a one-way valve 155 that permits fuel to flow into the fuel supply circuit 170 while preventing fuel in the fuel supply circuit 170 from flowing into the valve passage 150. The fuel supply circuit 170 opens into the air passage 30 through a high speed orifice 36 and a plurality of idle orifices 38. The amount of fuel that can exit into the air passage 30 through the high speed orifice 36 and idle orifices 38 is limited by a needle-type adjustable screw 172 in the fuel supply circuit 170. Air from the air passage 30 that enters the fuel supply circuit 70 through the high speed orifice 36 and idle orifices 38 is precluded from entering the valve passage by one-way valve 155.

During normal operation of the engine, subatmospheric air pulses passing through the air passage 30 and across the high speed orifice 36 and idle orifices 38 create a negative pressure in the metering chamber 70, causing a displacement of the metering diaphragm 72 away from the first surface 73. The displacement of the diaphragm opens the needle valve 80 and permits fuel to enter the metering chamber 70. Eventually, the flow of fuel into the metering chamber 70 increases the pressure in the metering chamber 70, causing the metering diaphragm 72 to move toward the wall and thereby close the needle valve 80 and stop the flow of fuel. The fuel exits the metering chamber through exit section 71 and enters the valve passage 150 through the first opening 151. The fuel passes through one-way valves 154 and 155 and then exits the valve passage 150 through the second opening 152. Continuing into the fuel supply circuit 170, the fuel passes through the high speed orifice 36 and idle orifices 38 and enters the air passage 30 where it is atomized.

As the fuel empties from the metering chamber 70, the pressure in the metering chamber 70 drops until the metering diaphragm 72 is again displaced away from the first surface 73 and the needle valve 80 opens. Thus, the metering diaphragm 72 repeatedly opens and closes the needle valve 80, thereby introducing metered amounts of fuel into the air passage 30. In this manner, the metering chamber 70, the diaphragm 72, the needle valve 80 and the other components associated therewith act as a fuel delivery device, delivering fuel to the air passage 30 in response to air flowing through the air passage 30.

When the engine is running, the air purging device (APD) 200 and the transfer device 100 do not contribute to the delivery of fuel to the engine. The APD 200 and the transfer device 100, however, play a prominent role in preparing the engine for a cold starting. Together, the APD 200 and the transfer device 100 help introduce an initial predetermined volume of fuel into the air passage 30 to prepare the engine for a cold start.

The APD 200 has an APD housing 201 with an inlet 202 and an outlet 203 passing therethrough. A check valve 204, such as an umbrella valve, is disposed over the inlet 202. A check valve 205, such as a duck bill valve, is disposed in the outlet 203. A resilient domed cap 206 is secured to the top of the APD housing 201 so as to define a pump chamber 210. An APD inlet line 214 connects the inlet 202 of the APD housing 201 to a fluid outlet passage 105 from the transfer device 100. An APD outlet line 216 connects the outlet 203 of the APD housing 201 to the fuel tank 250. The check valve 204 only permits fluid to flow into the pump chamber 210 from the APD inlet line 214 while check valve 205 only permits fluid to flow out of the pump chamber 210 into the APD outlet line 216.

The transfer device 100 includes a plate-like body 101 and a cover 102 having an orifice 103 passing therethrough. The body 101 has the first surface 73 and an opposing second surface 108. An injection or transfer chamber 110 is defined by the second surface 108 and a resilient transfer diaphragm 120 that is adjacent to the cover 102. The transfer chamber 110 is constructed to hold a transfer volume of fuel. The transfer chamber 110 is connected to the APD 200 and the valve passage 150 by the fluid outlet passage 105 and the fuel transfer passage 109 respectively.

In the first embodiment of the present invention illustrated in FIG. 1, the transfer device 100 is designed to be an "add-on" for a standard diaphragm carburetor. The metering chamber cover of the standard diaphragm carburetor is simply removed and replaced with the transfer device 100. It should be appreciated, however, that in other embodiments of the present invention, the transfer device 100 can be an integral part of the carburetor housing 20.

The transfer diaphragm 120 has two flat metal washers 112; one of the washers 112 is secured to an interior side of the transfer diaphragm 120 and another one of the washers 112 is secured to an exterior side of the transfer diaphragm 120. The transfer diaphragm 120 is biased against the cover 102 by a spring 130 positioned between the second surface 108 and the washer 112 on the interior side of the transfer diaphragm 120. A stem 115 extends from the transfer diaphragm 120 and projects through the orifice 103 in the cover 102. When the stem 115 is depressed, the transfer diaphragm 120 is displaced towards the second surface 108, reducing the volume of the transfer chamber 110. The washers 112 provide rigidity to the transfer diaphragm 120 at the point where the forces from the depressed stem 115 and spring 130 are applied, and enable maximum displacement of the entire transfer diaphragm 120.

Figure 2:
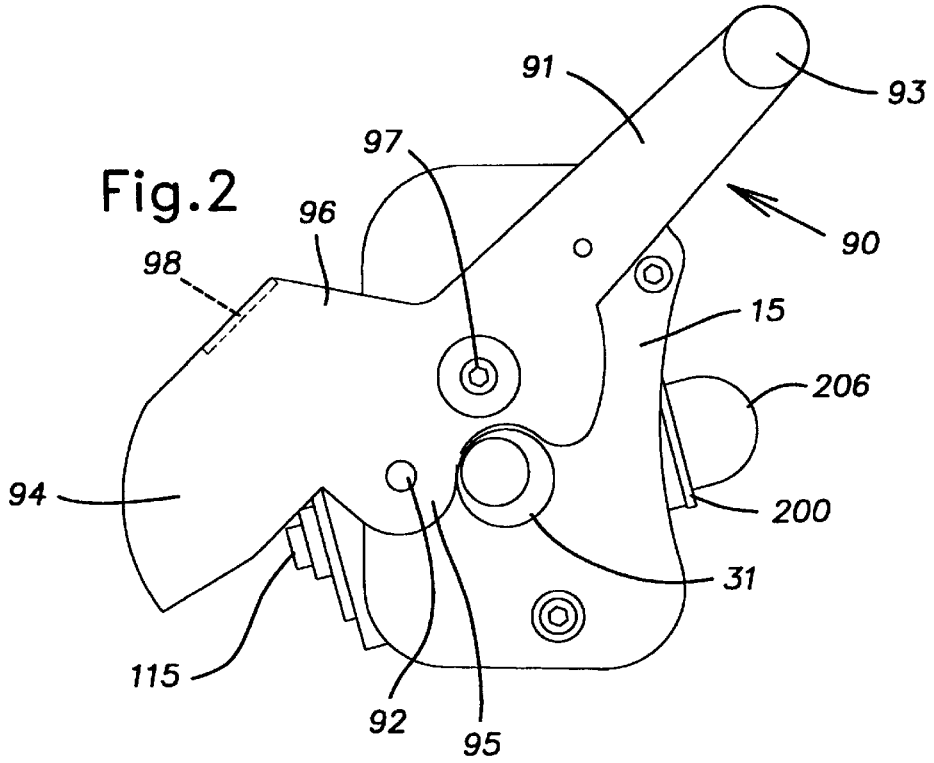
FIG. 2 shows an end view of a carburetor and a choke lever according to the first embodiment shown in FIG. 1, wherein the choke lever is in a disengaged position.
Figure 3:
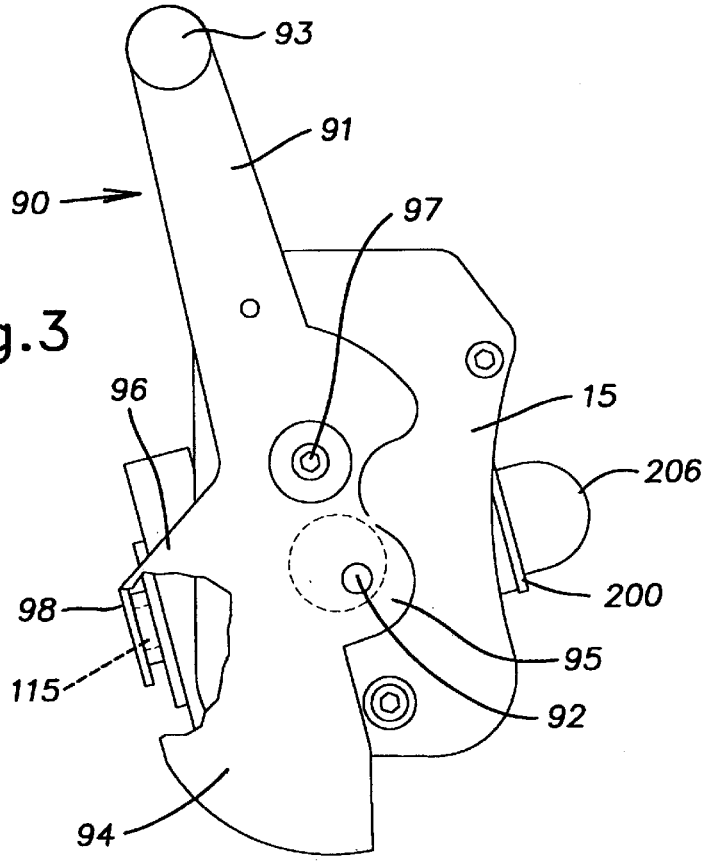
FIG. 3 shows an end view of the carburetor and the choke lever illustrated in FIG. 2, but with the choke lever in an engaged position.

Referring now to FIG. 2, an end view of the carburetor 10 shows the mounting plate 15 and the choke lever 90. The choke lever 90 is rotatably mounted to the carburetor 10 on a shaft 97 that passes through the mounting plate 15 and enters the carburetor housing 20. The choke lever 90 has an elongated portion 91 with a handle 93, a shoulder portion 96 and a semi-arcuate portion 94. The elongated portion 91 extends from the handle 93 to an arcuate end 95 having an inlet orifice 92 passing therethrough. As will be described in more detail later, the inlet orifice 92 is smaller than the air passage inlet 31 and is sized to provide a rich air/fuel mixture for the engine. A perpendicular flange 98 projects inward towards the carburetor 10 from the shoulder portion 96.

In FIG. 2, the choke lever 90 is in a disengaged or run position. The air passage inlet 31 is substantially free of obstruction and the stem 115 is in a fully extended position, urged outward by the action of the spring 130 on the transfer diaphragm 120. Thus, when the choke lever 90 is in the disengaged position, the air flow into the air passage 30 is substantially unrestricted and the volume of the transfer chamber 110 is not reduced.

In order to cold start the engine, the APD 200 is first activated. Referring back to FIG. 1, the domed cap 206 is manually depressed and released by the operator a number of times. When the domed cap 206 is depressed, air from the pump chamber 210 is expelled through the outlet 203 and into the APD outlet line 216. When the domed cap 206 is released, air from the transfer chamber 110 is drawn through the APD inlet line 214 and into the pump chamber 210 through inlet 202. As a result, air from the metering chamber 70 flows through exit section 71 and into the first opening 151 of the valve passage 150. The air then exits the valve passage 150 through the third opening 153 and enters the transfer chamber 110 where it is removed to the APD inlet line 214. In this manner, air is evacuated from the transfer chamber 110 and the metering chamber 70.

After the domed cap 206 is depressed a number of times, a negative pressure will be developed in the metering chamber 70 that is sufficient to deflect the metering diaphragm 72 away from the first surface 73 and open the needle valve 80, permitting fuel to enter the metering chamber 70. Fuel continues to flow into the metering chamber 70 while the domed cap 206 is being pumped, i.e., being repeatedly depressed and released. As a result, the metering chamber 70 becomes filled with fuel, causing fuel to exit the metering chamber 70 through the exit section 71 and travel into the valve passage 150 through the first opening 151. The fuel exits the valve passage 150 through third opening 153 and enters the transfer chamber 110. When the transfer chamber 110 is filled with fuel, fuel enters the APD inlet line 214, passes through the pump chamber 210 and is expelled into the fuel tank 250 through the APD outlet line 216. Once the transfer chamber 110 is filled with fuel, the pumping of the domed cap 206 is discontinued.

When the operation of the APD 200 is complete, the choke lever 90 is activated. Specifically, the choke lever 90 is rotated from the disengaged position shown in FIG. 2 to an engaged or start position shown in FIG. 3. During the rotational travel of the choke lever 90, the perpendicular flange 98 depresses the stem 115. As the stem 115 is depressed, the transfer diaphragm 120 is displaced towards the second surface 108. The displacement of the transfer diaphragm 120 reduces the volume of the transfer chamber 110, forcing most of the fuel out of the transfer chamber 110. Since the flow path into the APD 200 is more restrictive than the flow path through the fuel transfer passage 109, most of the fuel that is forced out of the transfer chamber 110 enters the fuel transfer passage 109. An amount of fuel, however, does enter the APD inlet line 214 through the fluid outlet passage 105, but this amount is minimal. The fuel that enters the fuel transfer passage 109 passes into the valve passage 150 through the third opening 153. The fuel then exits the valve passage 150 through one-way valve 155 and enters the fuel supply circuit 170. From the fuel supply circuit 170, the fuel enters the air passage 130 through the high speed orifice 36 and idle orifices 38. Thus, it can be seen that the fuel transfer passage 109, valve passage 150 and the fuel supply circuit 170, including the adjustable screw 172 disposed therein, combine to define a fuel circuit that interconnects the air passage 30, the metering chamber 70 and the transfer chamber 110. The travel of fuel through the fuel circuit from the transfer chamber 110 to the air passage 30 is very fast and transpires almost instantaneously with the displacement of the transfer diaphragm 120.

When the choke lever 90 reaches the engaged position, the stem 115 is depressed to a point where the transfer diaphragm 120 is fully deflected and substantially all of the transfer volume of fuel has been expelled from the transfer chamber 110. The volume of fuel that is injected into the air passage 30 when the choke lever 90 is activated is slightly less than the transfer volume because of a fuel loss that occurs as a result of fuel entering the APD inlet 214 and as a result of residual fuel remaining in the transfer chamber 110 and the fuel supply circuit 170 after the choke lever 90 is activated. Since the fuel loss is substantially the same each time the choke lever 90 is activated, the volume of fuel injected into the air passage 30 when the choke lever 90 is activated is constant. Accordingly, the transfer chamber 110 is sized such that the transfer volume minus the fuel loss yields a predetermined volume of fuel that will create an ideal air-fuel mixture for starting the engine when it is injected into the air passage 30 upon activation of the choke lever 90.

When the choke lever 90 is in the engaged position, the arcuate end 95 of the choke lever 90 covers the air passage inlet 31. In this position, the inlet orifice 92 overlies the air passage inlet 31 and provides the only opening through which air may enter the air passage 30. Thus, the movement of the choke lever 90 from the disengaged position to the engaged position simultaneously restricts air flow into the air passage 30 and quickly injects the predetermined volume of fuel into the air passage 30. Accordingly, the carburetor 10 is placed in an optimal condition for starting the engine soon after the choke lever 90 is activated.

When the engine is subsequently cranked either manually by a pull-rope or automatically by a starter motor, the air and the predetermined volume of fuel in the air passage 30 will be sucked into the combustion chamber of the engine. The engine will usually start after the first crank since the air-fuel mixture produced by the predetermined volume of fuel readily supports combustion. The period of time during which the engine runs with the choke lever 90 in the engaged position is referred to as the "run-on" time. During the run-on time, additional fuel is supplied to the air passage 30 from the metering chamber 70 as a result of the increased suction that is created by the restriction of air flow into the air passage 30. Once the engine has warmed up, the choke lever 90 is moved to the run position, which opens the air passage inlet 31 and permits the spring 130 to move the transfer diaphragm 120 back to its original position against the cover 102.

Since the fuel system 5 injects the predetermined volume of fuel into the air passage 30 before the first crank of the engine, the amount of restriction or choke applied to the air passage 30 does not have to be as great as in prior art fuel delivery systems. Accordingly, the area of the inlet orifice 92 in the choke lever 90 is substantially larger than the area of an orifice in a typical prior art choke mechanism. The area of the inlet orifice 92 is purposefully sized to fall within a desired range such that enough suction is created in the air passage 30 to draw fuel for running after the engine is started, without producing so much suction that the engine will flood. Each area within the desired range 92 permits the engine to start and produce an adequate run-on time at typical ambient temperatures, i.e., from 40° to 100° F. During the run-on time the engine will operate in a somewhat fuel-rich condition, which is desirable for warm-up purposes. As a result, the need to move to an intermediary or "half-choke" position is eliminated.

The size of the inlet orifice 92 is proportional to the displacement of the engine. An example of the sizing of the inlet orifice 92 is presently provided. In this example, the engine has a capacity of 24 cubic centimeters. The diameter of the air passage 30 at the inlet 31 and in the throttle bore 34 is 0.5 inches. The diameter of the air passage at the restriction is 0.289 inches. The length of the throttle bore 34 is 0.465 inches while the total length of the air passage 30 is 1.129 inches. With these dimensions, the desired range of areas for the inlet orifice 92 was determined to be from 0.238 inches to 0.242 inches.

In addition to eliminating the need for a full-choke/half-choke starting procedure, the fuel system 5 practically eliminates the possibility of over-priming and flooding the engine. Excessive fuel cannot enter the air passage 30 during the operation of the APD 200 or the activation of the choke lever 90. If the domed cap 206 of the APD 200 continues to be pumped after the metering chamber 70 and the transfer chamber 110 have been filled, the excess fuel will be pumped back into the fuel tank 250 rather than into the air passage 30 or the environment. When the choke lever 90 is moved to the engaged position, only the predetermined volume of fuel from the transfer chamber 110 enters the air passage 30. Even if the engine does not start after the first crank, the engine will not flood as a result of subsequent cranks of the engine. Since the amount of restriction applied to the air passage 30 by the inlet orifice 92 is reduced, the amount of fuel drawn into the air passage 30 by a single crank of the engine is insufficient to flood the engine. Air that is pulled through the air passage 30 by a crank of the engine clears the air passage 30 of fuel that is drawn into the air passage by a preceding crank of the engine, thereby preventing a build-up of fuel in the air passage 30 caused by repeated cranks of the engine.

As is known in the prior art, if the engine does not start after the first crank, the engine is cranked again until it starts.

Figure 4:
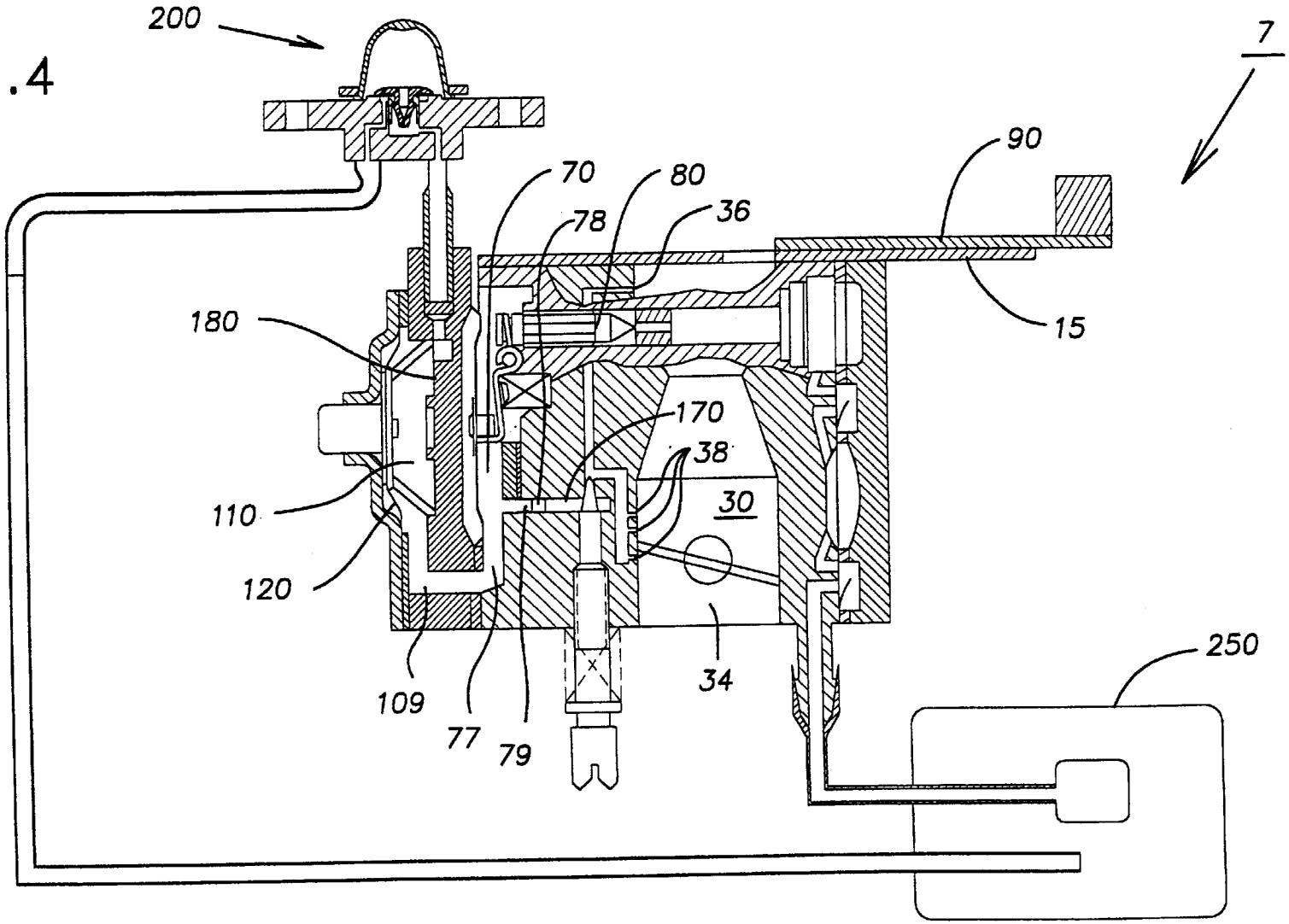
FIG. 4 shows a schematic view of a fuel system according to a second embodiment of the present invention.

Referring now to FIG. 4, there is shown a second embodiment of the present invention. Specifically, FIG. 4 shows a fuel system 7 having essentially the same construction as the fuel system 5 of the first embodiment shown in FIG. 1 except for the differences to be hereinafter described. In the fuel system 7, the valve passage 150 and the exit section 71 are not present. The fuel transfer passage 109 is connected to a transfer opening 77 in the metering chamber 70. The fuel supply circuit 170 is connected to an exit opening 79 in the metering chamber 70. A one-way valve 78 is situated in the exit opening 79 to prevent air from entering the metering chamber 70 from the fuel supply circuit 170. As in the first embodiment, the transfer device 100 in the fuel system 7 of the second embodiment is an add-on for a standard diaphragm carburetor.

The operation of the fuel system 7 of the second embodiment is essentially the same as the fuel system 5 of the first embodiment except for the differences to be hereinafter described. Prior to cold starting the engine, the APD 200 is activated. Fuel enters the metering chamber 70 through the needle valve 80 and subsequently exits the metering chamber 70 through the transfer opening 77. The fuel enters the fuel transfer passage 109 and travels to the transfer chamber 110. When the transfer chamber 110 is filled with fuel, the operation of the APD 200 is complete.

When the operation of the APD 200 is complete, the choke lever 90 is activated, causing the perpendicular flange 98 to depress the stem 115. When the stem 115 is depressed, the transfer diaphragm 120 is displaced towards the second surface 108. The displacement of the transfer diaphragm 120 reduces the volume of the transfer chamber 110, forcing most of the fuel out of the transfer chamber 110. Since the flow path into the APD 200 is more restrictive than the flow path through the fuel transfer passage 109, most of the fuel that is forced out of the transfer chamber 110 enters the fuel transfer passage 109. An amount of fuel, however, does enter the APD inlet line 214 through the fluid outlet passage 105, but this amount is minimal. The fuel that enters the fuel transfer passage 109, passes through the transfer opening 77 and enters the metering chamber 70. As a result of residual fuel losses, the volume of fuel that is injected into the metering chamber 70 is slightly less than the transfer volume, but is still a predetermined or set volume of fuel.

As a result of the injection of the set volume of fuel, the metering chamber 70 expands or "fattens" so as to be over-filled with fuel. Thereafter, an excess volume of fuel substantially equal to the set volume of fuel is expressed from the metering chamber 70 by the metering diaphragm 72. The excess volume of fuel exits the metering chamber 70 through the exit opening 79, passes through the fuel supply circuit 170 and enters the air passage 30. The travel of the excess volume of fuel from the metering chamber 70 to the air passage 30 takes a few seconds. As a result, a portion of the excess volume of fuel may still be retained in the metering chamber 70 and fuel supply circuit 170 when the engine is cranked subsequent to the activation of the choke lever 90. A small vacuum, however, will draw this retained portion into the air passage 30. Accordingly, after a first crank of the engine, the excess volume of fuel will have travelled into the air passage 30 through the high speed orifice 36 and idle orifices 38, creating a temporary fuel-rich air/fuel mixture necessary for a cold start.

In the fuel system 7 of the second embodiment, the activation of the choke lever 90 also causes the arcuate end 95 of the choke lever 90 to cover the air passage inlet 31, thereby limiting the amount of air entering the air passage 30 to the flow of air passing through the inlet orifice 92. Thus, in the second embodiment, the activation of the choke lever 90 simultaneously restricts air flow into the air passage 30 and injects the set volume of fuel into the metering chamber 70, causing the metering chamber 70 to fatten and the excess volume of fuel to enter the air passage 30. However, the overflow of the metering chamber 70 does not occur immediately after the activation of the choke lever 90. A few seconds have to transpire before the carburetor 10 is ready for an engine start.

As can be appreciated, the second embodiment operates differently than the first embodiment. However, the second embodiment affords substantially the same benefits as the first embodiment. In the second embodiment as in the first embodiment, the amount of choke applied to the air passage 30 does not have to be as great as in prior art fuel delivery systems. Accordingly, the second embodiment eliminates the need for a full-choke/half-choke starting procedure. In addition, excessive fuel cannot enter the air passage 30 during the operation of the APD 200 or the activation of the choke lever 90. Accordingly, the second embodiment substantially reduces the chances of over-priming and flooding.

Figure 5:
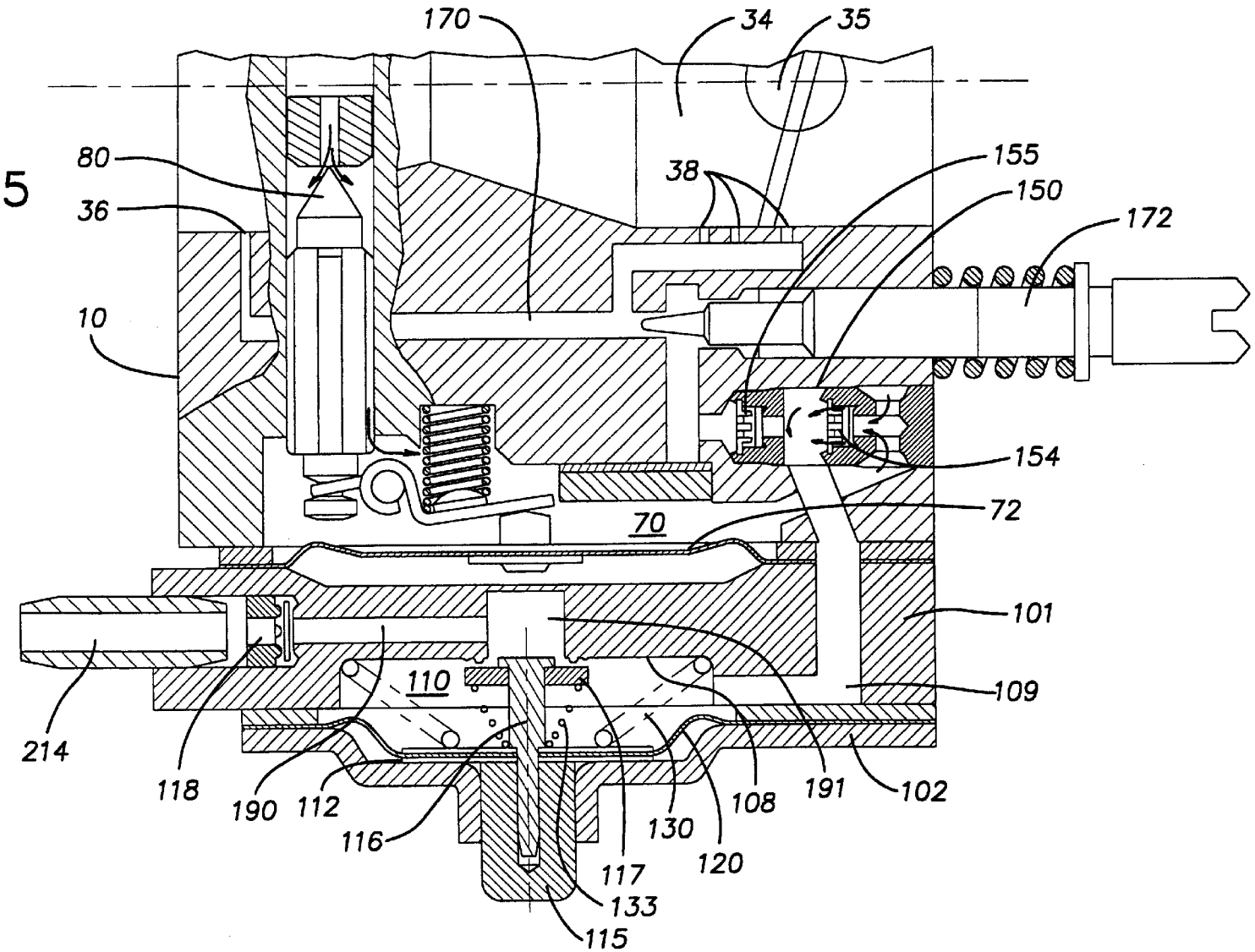
FIG. 5 shows a schematic view of the carburetor in a first modified version of the first embodiment illustrated in FIG. 1, wherein the carburetor includes valves for preventing fuel from flowing into an air line.

It should be appreciated that modifications can be made to the first and second embodiments of the present invention that will prevent fuel from flowing into the APD inlet line 214 when the transfer diaphragm 120 is deflected. A first modified version of the first embodiment is shown in FIG. 5 having these flow prevention modifications. The fluid outlet passage 105 connecting the APD inlet line 214 to the transfer chamber 110 is not present. The APD inlet line 214 is instead connected to the transfer chamber 110 through an air conduit 190 and a cavity 191. The air conduit 190 has an enlarged portion and a diminished portion. Although not required, a check valve 118 is disposed in the enlarged portion of the air conduit 190 just before the juncture of the air line 214 and the air conduit 190. The air conduit 190 leads to the cavity 191, which opens into the transfer chamber 110 through the second surface 108.

An extension 116 projects downward from the stem 115 and is aligned with the cavity 191. The extension 116 has a cylindrical body and an end flange, both of which readily fit inside the cavity 191. Disposed around the cylindrical body of the extension 116 is an annular sealing element 117 that extends out laterally beyond the perimeter of the cavity 191. The annular sealing element 117 can slide up and down the cylindrical body, but cannot fit over the end flange. The annular sealing element 117 is biased against the end flange by an extension spring 133 positioned between the annular sealing element 117 and the washer 112 on the interior side of the transfer diaphragm 120. In this position, the annular sealing element 117 is located just above the second surface 108.

When the choke lever 90 is activated and the stem 115 is depressed, the extension 116 and the annular sealing element 117 move downward towards the cavity 191. The annular sealing element 117 quickly contacts the second surface 108 and is prevented from moving downward any further. In this position, the annular sealing element 117 seals the cavity 191 and prevents fuel in the transfer chamber 110 from entering the cavity 191. However, the extension 116 slides through the annular sealing element 117 and travels through the cavity 191 until the transfer diaphragm 120 is fully deflected. In this manner, the activation of the choke lever 90 fully deflects the transfer diaphragm 120 and expresses fuel out of the transfer chamber 110 without displacing fuel into the APD inlet line 214.

Figure 6:
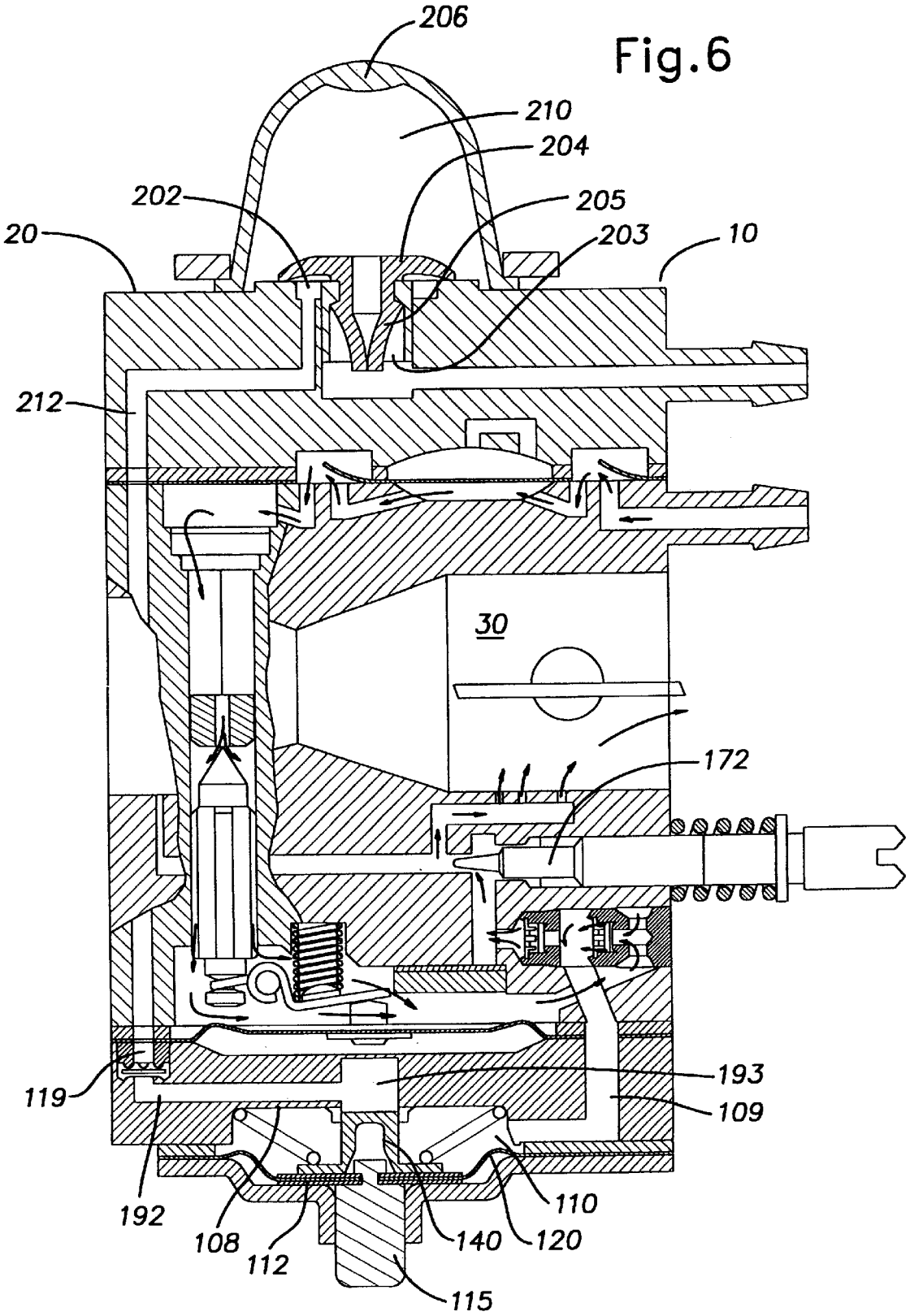
FIG. 6 shows a schematic view of the carburetor in a second modified version of the first embodiment illustrated in FIG. 1, wherein an air purging device is integrated into the carburetor and the carburetor includes valves for preventing fuel from flowing into an air line.

A second modified version of the first embodiment is shown in FIG. 6. The APD 200 has been integrated into the carburetor 10 and modifications have been made to prevent fuel flow towards the APD 200 when the transfer diaphragm 120 is deflected. The APD housing 201 has been removed and, therefore, no longer helps define the pump chamber 210. Instead, the carburetor housing 20 helps define the pump chamber 210. The inlet 202 and the outlet 203 of the APD 200 are disposed inside the carburetor housing 20, while the resilient domed cap 206 is secured to an outside surface of the carburetor housing 20.

Another component of the APD 200 that has been removed is the APD inlet line 214. Since the APD 200 is integral with the carburetor 10, the APD inlet line 214 is replaced by an APD inlet passage 212 that extends through the carburetor housing 20. The APD inlet passage 212 connects the inlet 202 to an APD conduit 192. The APD conduit 192 leads to a chamber 193, which opens into the transfer chamber 110 through the second surface 108. The APD conduit 192 and the chamber 193 replace the fluid outlet passage 105. Although not required, a check valve 119 is disposed in the APD inlet passage 212 near the juncture of the APD inlet passage 212 and the APD conduit 192.

A plug 140 with an upper flange is provided for sealing the chamber 193. The upper flange is secured to the washer 112 on the interior side of the transfer diaphragm 120. The plug 140 projects downward from the upper flange and is aligned with the chamber 193. The plug 140 is sized so as to snugly fit into the chamber 193. A discontinuous, ring-shaped ridge is formed in the second surface 108 around the periphery of the opening leading into the chamber 193. The ridge helps guide the plug 140 into the chamber 193 and allows fuel to flow into the chamber 193 when the APD 200 is circulating fuel through the carburetor 10. When the choke lever 90 is activated and the stem 115 is depressed, the plug 140 moves downward into the chamber 193, thereby sealing the chamber 193 and preventing displaced fuel from entering the APD conduit 192.

Figure 7:
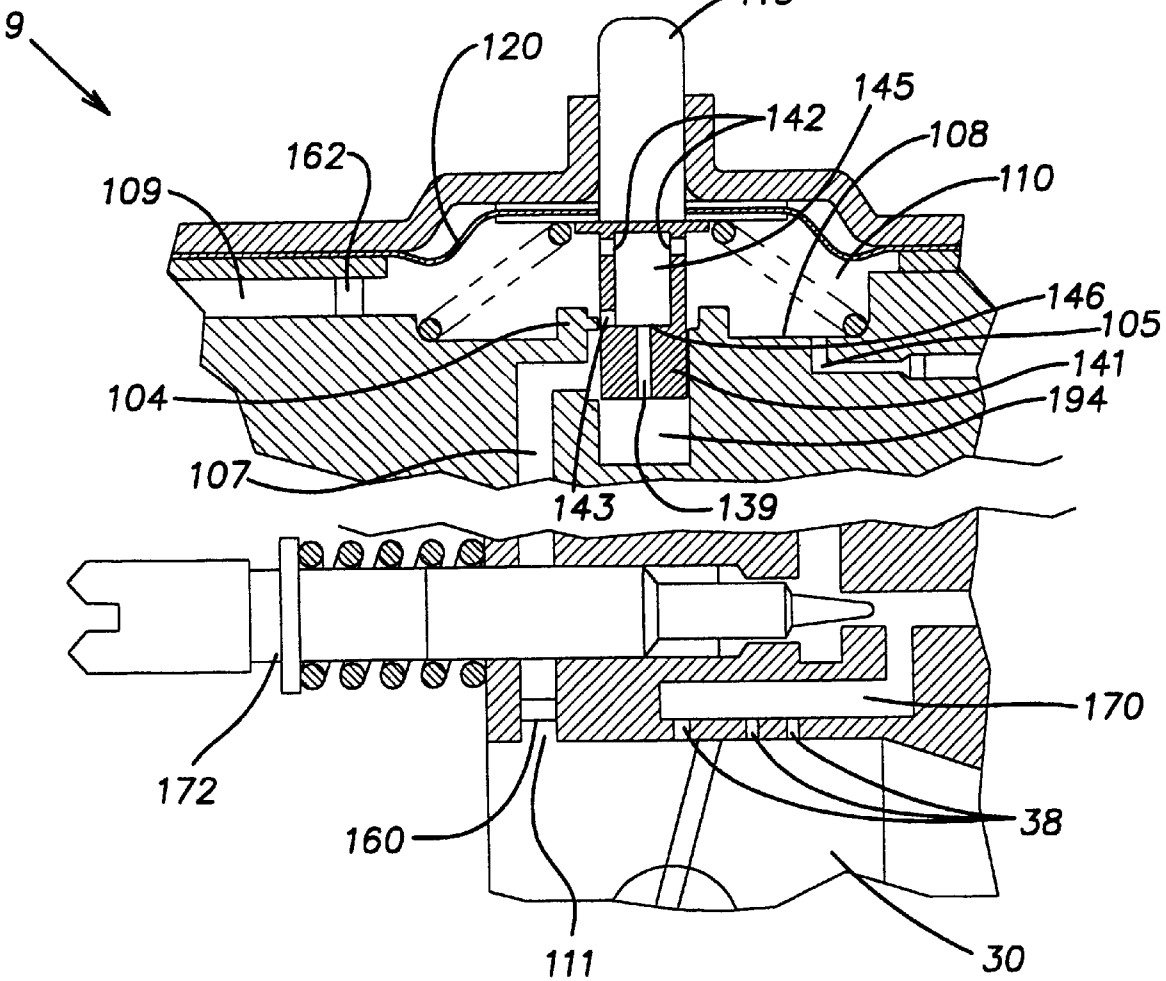
FIG. 7 shows a schematic view of a portion of the carburetor in a fuel system according to a third embodiment of the present invention.

Referring now to FIG. 7, there is shown a portion of a third embodiment of the present invention. Specifically, FIG. 7 is a schematic view of a portion of a fuel system 9 having essentially the same construction as the fuel system 7 of the second embodiment except for the differences to be hereinafter described. A fuel injection passage 107 has been added to provide a dedicated path from the transfer chamber 110 to the air passage 30. For purposes of brevity, the entire fuel injection passage 107 is not shown. Only inlet and outlet portions of the fuel injection passage 107 are shown. Between the inlet and outlet portions, the fuel injection passage 107 is continuous and does not intersect any other passage.

The inlet portion of the fuel injection passage 107 opens into a recess in a side wall of a chamber or hollow 194. The hollow 194, in turn, opens into the transfer chamber 110 through a second surface 108'. Aligned above the hollow 194, is an extension 141 projecting downward from the washer 112 on the interior side of the transfer diaphragm 120. The hollow 194 is sized to receive the extension 141 in a snug manner when the stem 115 is depressed and the transfer diaphragm 120 deflected. A ridge 104 with an interior notch is formed in the second surface 108 around the periphery of the opening leading into the hollow 194. The ridge 104 helps guide the extension 141 into the hollow 194.

The extension 141 has an interior cavity 145 and an upper flange. The interior cavity 145 extends for only a portion of the extension 141, beginning at the upper flange and projecting downward to a bottom cavity wall 146. A bore 139 passes through the bottom of the extension 141 and enters the interior cavity 145 through an opening in the bottom cavity wall 146. The bore 139 permits fuel that may be present in the bottom of the hollow 194 to enter the interior cavity 145 when the extension 141 is depressed. In this manner, the fuel is prevented from blocking the travel of the extension 141 when the extension is depressed.

The upper flange is secured to the washer 112 on the interior side of the transfer diaphragm 120. A pair of upper openings 142 are disposed on opposing sides of the extension 141 near the upper flange. The upper openings 142 pass through the extension 141 and into the interior cavity 145. A lower opening 143 is disposed on a side of the extension 141 that is adjacent to the recess in the side wall of hollow 194 when the extension 141 is received in the hollow 194. The lower opening 143 passes through the extension 141 and enters the interior cavity 145 near the bottom cavity wall 146.

The outlet portion of the fuel injection passage 107 opens into the air passage 30 through an opening 111. A check valve 160 is disposed within the outlet portion of the fuel injection passage just before the opening 111. The check valve 160 allows fuel from the fuel injection passage 107 to pass into the air passage 30, but prevents fuel or air in the air passage 30 from passing into the fuel injection passage 107. When the APD 200 is activated, the APD 200 evacuates air from the transfer chamber 110 and the metering chamber 70 through the fluid outlet passage 105, thereby causing the metering chamber 70 to fill with fuel. Fuel from the metering chamber 70 travels through the fuel transfer passage 109 and enters the transfer chamber 110 through a check valve 162. As fuel begins to fill the transfer chamber 110, fuel enters the interior cavity 145 of the extension 141 through the upper openings 142 and the lower opening 143. Fuel continues to enter the interior cavity 145 until the interior cavity 145 is filled with fuel. When the operation of the APD 200 is complete, the transfer chamber 110 and the interior cavity 145 are filled with a transfer volume of fuel that will be injected into the fuel injection passage 107 when the choke lever 90 is activated. The check valve 162 disposed in the fuel transfer passage 109 prevents fuel in the transfer chamber 110 from entering the fuel transfer passage 109 when the choke lever 90 is activated.

When the choke lever 90 is activated, the choke lever 90 depresses the stem 115, thereby moving the transfer diaphragm 120 towards the second surface 108. The depression of the stem 115 also moves the extension 141 into the hollow 194. During the initial movement of the extension 141 through the hollow 194, the lower opening 143 is pressed against the side wall of the hollow 194 and, thus, is effectively covered. However, as the extension 141 continues to move through the hollow 194, the lower opening 143 passes by the recess and becomes uncovered. As a result, a fuel path is created that extends through the upper openings 142, passes through the interior cavity 145 and exits through the lower opening 143. The fuel path connects the transfer chamber 110 with the recess in the hollow 194. As the transfer diaphragm 120 moves towards the second surface 108, displaced fuel travels through the fuel path and enters the inlet portion of the fuel injection passage 107. The fuel travels to the outlet portion of the fuel injection passage 107 and exits into the air passage 30.

When the choke lever 90 reaches the engaged position, the stem 115 is depressed to a point where the transfer diaphragm 120 is fully deflected and substantially all of the transfer volume of fuel in the transfer chamber 110 has been expelled from the transfer chamber 110. As a result of residual fuel losses, however, the volume of fuel that is injected into the air passage 30 by the activation of the choke lever 90 is slightly less than the transfer volume, but is still a predetermined volume of fuel. In addition to the transfer diaphragm 120 being fully deflected, the extension 141 is fully inserted into the hollow 194, thereby causing the lower opening 143 to be positioned below the recess. In this position, the lower opening 143 is again pressed against the side wall of the hollow 194 so as to be covered. Thus, the transfer chamber 110 is sealed from the fuel injection passage 107 when the choke lever 90 is in the engaged position, thereby preventing the communication of suction from the air passage 30 to the transfer chamber 110.

In the fuel system 9 of the third embodiment, as in the first and second embodiments, the activation of the choke lever 90 also causes the arcuate end 95 of the choke lever 90 to cover the air passage inlet 31, thereby limiting the amount of air entering the air passage 30 to the flow of air passing through the inlet orifice 92. Thus, in the third embodiment, the activation of the choke lever 90 simultaneously restricts air flow into the air passage 30 and very quickly injects a predetermined volume of fuel into the air passage 30. Since the fuel flow from the transfer chamber 110 is not impeded by the adjustable screw 172, the injection of fuel into the air passage 30 occurs even faster in the third embodiment than in the first embodiment. Accordingly, the activation of the choke lever 90 almost instantaneously places the carburetor 10 in an optimal condition for starting the engine.

Figure 8:
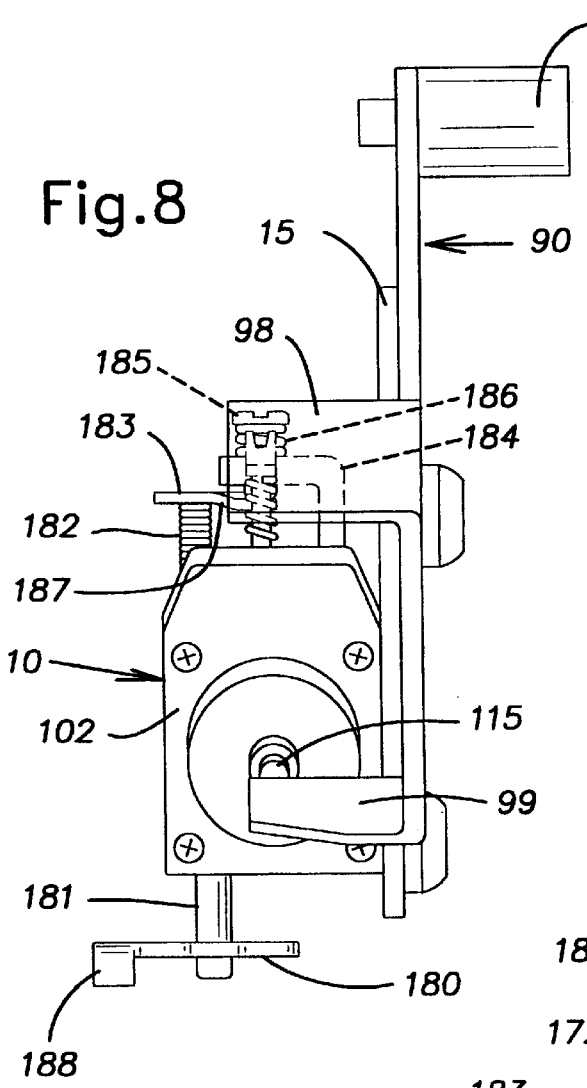
FIG. 8 shows a side view of the carburetor and the choke lever in a fuel system according to a fourth embodiment of the present invention which automatically opens the throttle valve, wherein the choke lever is in a disengaged position.

Referring now to FIG. 8, there is shown a side view of a portion of a fuel system according to a fourth embodiment of the present invention. The fourth embodiment has essentially the same construction as the fuel system 5 of the first embodiment except for the differences to be hereinafter described. An angular extension 184 projects upward from the top of the carburetor housing 20 and then projects inward toward the adjustment screw 172. A threaded hole (not shown) passes through the inward projecting portion of the angular extension 184. Threadably disposed within the hole is a screw 185 with a tapered end. The movement of the screw 185 through the hole is resisted by a spring 186.

A bore (not shown) passes through the carburetor housing 20 from the top of the carburetor 10 to the bottom of the carburetor 10. A shaft 181 is rotatably disposed within the bore and extends through the air passage 30. The throttle valve 35 is secured to the shaft 181 so as to open and close with the rotation of the shaft 181. Specifically, the throttle valve 35 opens when the shaft 181 rotates in a counter-clockwise direction as viewed from the top of the carburetor 10. Conversely, the throttle valve closes when the shaft 181 rotates in a clockwise direction as viewed from the top of the carburetor 10. A spring 182 applies a closing torque to the shaft 181 that urges the shaft 181 to rotate in the clockwise direction and close the throttle valve 35. The shaft extends out from the top and the bottom of the carburetor 10. A lower contact plate 180 is secured to the bottom of the shaft 181 while an upper contact plate 183 is secured to the top of the shaft 181.

The lower contact plate 180 has first and second portions extending out from the shaft 181 in opposite directions. The first and second portions each have a straight side and an opposing arcuate side. A small flange 188 projects downward from the arcuate side of the first portion of the lower contact plate 180. The lower contact plate 180 is secured to the shaft 181 such that the straight sides of the first and second portions of the lower contact plate 180 are substantially perpendicular to the choke lever 90 when the throttle valve 35 is closed, as is shown in FIG. 8.

The upper contact plate 183 has an irregular-shaped body 187 with a short tab (not shown) projecting outward therefrom. The upper contact plate 183 is secured to the top of the shaft 181 such that when the throttle valve 35 is closed, the short tab extends underneath the angular extension 184, but terminates just short of the center of the threaded hole in the angular extension 184. Thus, when the screw 185 is positioned in the hole such that the tip of its tapered end is level with the short tab, the screw 185 does not contact the upper contact plate 183 and the throttle valve 35 is permitted to close. However, when the screw 185 is moved farther through the hole, the diameter of the portion of the screw 185 that is level with the short tab increases. As a result, the screw 185 contacts the short tab before the throttle valve 35 reaches the closed position. Accordingly, the throttle valve 35 is prevented from closing and a minimum opening for the throttle valve 35 is created by moving the screw 185 downward. Since the end of the screw 185 is tapered, the farther the screw 185 is moved downward, the greater the minimum opening will be. However, once the body of the screw 185 becomes level with the short tab, the downward movement of the screw 185 will no longer increase the minimum opening.

The opening of the throttle valve 35 is accomplished by the lower contact plate 180 and a tapered flange 99 that has been added to the semi-arcuate portion 94 of the choke lever 90. The tapered flange 99 projects inward towards the carburetor 10 from the lower portion of the substantially straight side of the semi-arcuate portion 94. When the choke lever 90 is in the disengaged position as is shown in FIG. 8, the tapered flange 99 is located to the side of the carburetor 10, above the lower contact plate 180. The throttle valve 35 is closed as a result of the closing torque applied to the shaft 181 by the spring 182. In addition, the perpendicular flange of the choke lever 90 is not depressing the stem 115 and, although not shown, the arcuate end 95 of the choke lever 90 is not covering the inlet 31 to the air passage 30.

When the choke lever 90 is rotated towards the engaged position, the tapered flange 99 moves downward and underneath the carburetor 10. During the rotational travel of the choke lever 90, the tapered flange 99 contacts the arcuate side of the second portion of the lower contact plate 180, causing the lower contact plate 180 to apply an opening torque to the shaft 181. The opening torque overcomes the closing torque applied by the spring 182 and rotates the shaft 181 in the counter-clockwise direction, opening the throttle valve 35.

Figure 9:
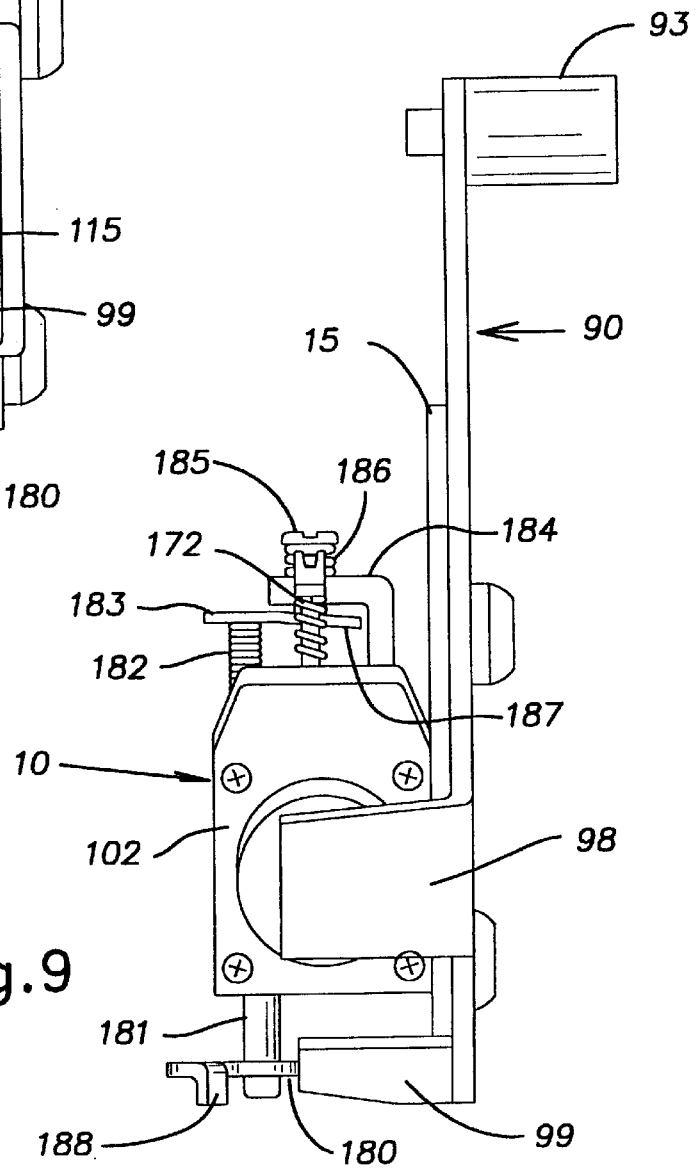
FIG. 9 shows a side view of the carburetor and the choke lever illustrated in FIG. 8, but with the choke lever in an engaged position.

Referring now to FIG. 9, the choke lever 90 is shown in the engaged position. The tapered flange 99 is pressed against the lower contact plate 180, holding the lower contact plate 180 in a position that fully opens the throttle valve 35. In addition, the perpendicular flange of the choke lever 90 is depressing the stem 115 and, although not shown, the arcuate end 95 of the choke lever 90 is covering the inlet 31 to the air passage 30. Thus, the rotation of the choke lever 90 from the disengaged position to the engaged position has simultaneously opened the throttle valve 35, restricted air flow into the air passage 30 and injected the predetermined volume of fuel into the air passage 30.

It should be appreciated that the fourth embodiment can be provided in the fuel system 7 of the second embodiment instead of the illustrated fuel system 5 of the first embodiment. The fourth embodiment would have essentially the same structure as the fuel system 7 of the second embodiment shown in FIG. 4 except for the differences set forth above, i.e., the addition of the upper contact plate 183, the lower contact plate 180, the tapered flange 99, etc.

Figure 10:
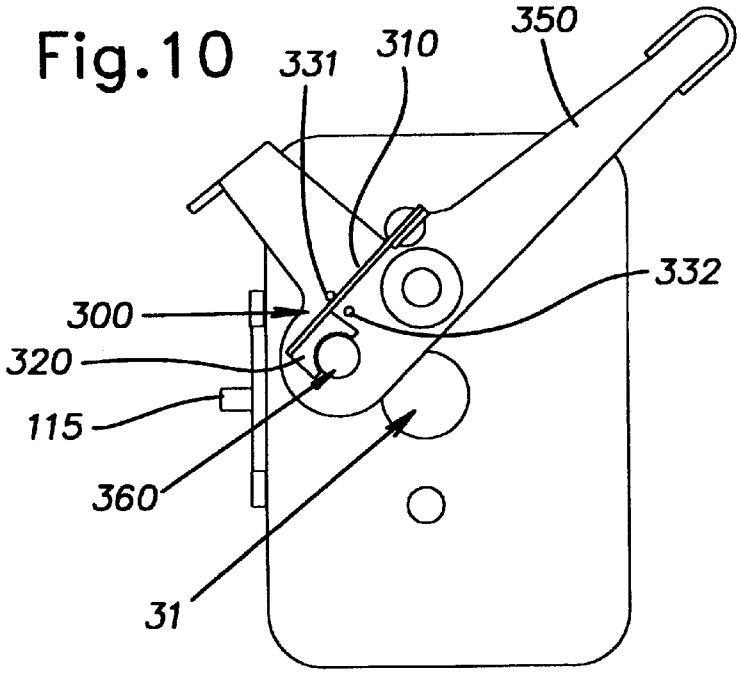
FIG. 10 illustrates an embodiment of the choke lever having temperature compensation, wherein the ambient air is at a maximum temperature.

Other embodiments of the present invention provide automatic temperature compensation. Referring now to FIG. 10, there is shown a portion of a fuel system having essentially the same construction as either the fuel system 5 of the first embodiment or the fuel system 7 of the second embodiment except for the differences to be hereinafter described. A compensating choke arm 350 is shown having an arm inlet 360 and a deflecting element 300 for providing temperature compensation. The deflecting element 300 has a bimetallic lever 310 secured at one end to the compensating choke arm 350. The other end of the bimetallic lever 310 is fitted with an end piece 320 that is concave. It should be appreciated that the end piece 320 does not have to be concave and can have other shapes. The bimetallic lever 310 is composed of two types of metal having different expansion ratios. FIG. 10 shows the deflecting element 300 at a selected maximum temperature such as 100° F. The bimetallic lever 310 is substantially straight and is resting against an outer travel limiter 331. In this configuration, the end piece 320 is spaced from the arm inlet 360, leaving the arm inlet 360 uncovered.

The difference in expansion ratios causes the bimetallic lever 310 to bend inward as the temperature drops from the maximum temperature. As the bimetallic lever 310 bends inward, the end piece 320 moves over the arm inlet 360, effectively reducing its area. This reduction in area decreases the amount of air that can enter the air passage 30 through the arm inlet 360 when the compensating choke arm 350 is activated, thereby increasing the vacuum in the air passage 30 when the engine is cranked. In this manner, the amount of vacuum created in the air passage 30 is increased as the temperature drops. It is desirable to increase the vacuum and, thus, the fuel draw as the temperature decreases because a richer mixture is required as the temperature decreases.

Figure 11:
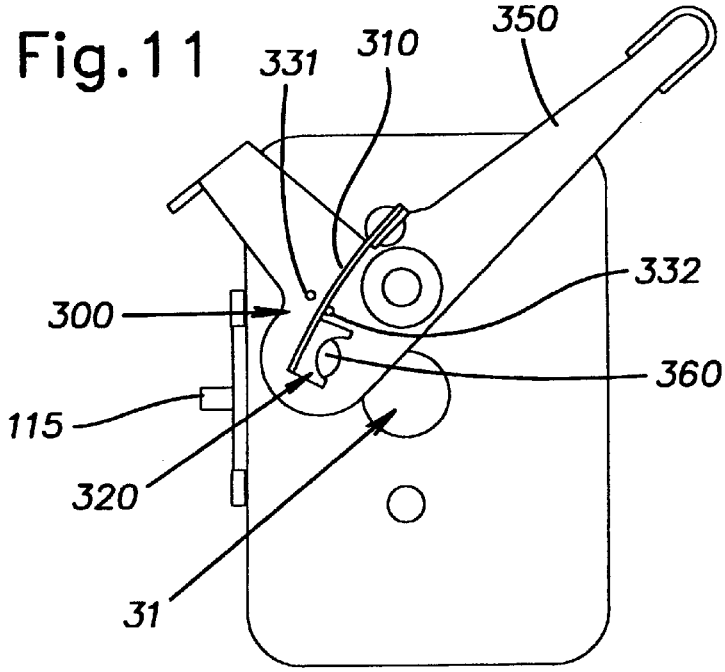
FIG. 11 shows the choke lever of FIG. 10, but wherein the ambient air is at a minimum temperature.

Referring now to FIG. 11, the compensating choke arm 350 is shown with the deflecting element 300 in a bent configuration at a selected minimum temperature such as 32° Fahrenheit. The bimetallic lever 310 is resting against an inner travel limiter 332 and the end piece 320 is covering approximately half of the arm inlet 360. In this configuration, the arm inlet 360 is reduced to its smallest area and will create the largest vacuum and, thus, the richest fuel/air ratio when the compensating choke arm 350 is activated and the engine is cranked.

It should be appreciated that the size of the arm inlet 360, the construction of the deflecting element 300 and the placement of the limiters 331, 332 are based upon the minimum and maximum temperatures. If the minimum temperature or the maximum temperature is changed, the size of the arm inlet 360, the construction of the deflecting element 300 and/or the placement of the limiters 331, 332 would be changed. For example, if a higher maximum temperature such as 120° F. was desired, the size of the arm inlet 360 would be increased and the construction of the deflecting element 300 and/or placement of the limiters 331, 332 would be changed to cause the deflecting element 300 to travel farther with changes in temperature.

Figure 12:
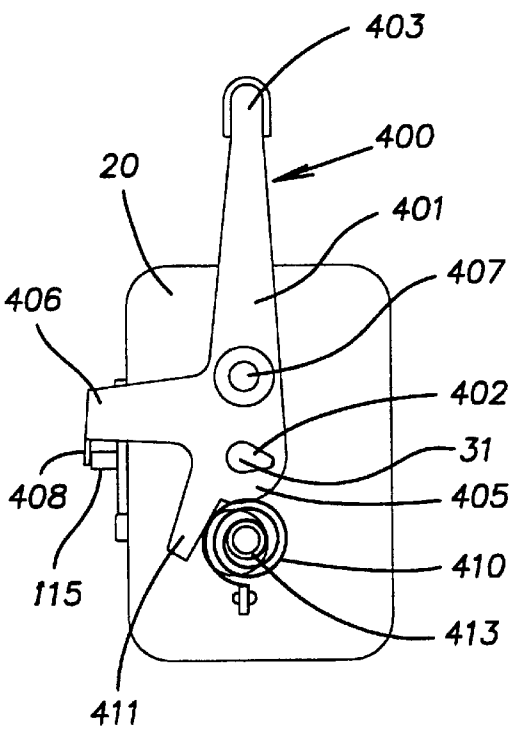
FIG. 12 shows another embodiment of the present invention including a travel-limited choke arm and a thermal spring.

Referring now to FIG. 12, there is shown an end view of a portion of another embodiment of the present invention having temperature compensation. Specifically, FIG. 12 shows a portion of a fuel system having essentially the same construction as either the fuel system 5 of the first embodiment or the fuel system 7 of the second embodiment except for the differences to be hereinafter described. A travel-limited choke arm 400 is provided that is rotatably mounted to the carburetor housing 20 through a shaft 407. The travel-limited choke arm 400 has an elongated portion 401, a shoulder portion 406 and a leg portion 411. The elongated portion 401 tapers from a semi-arcuate end 405 to a smaller arcuate end 403. The semi-arcuate end 405 has a teardrop-shaped opening 402 passing therethrough. At the outer end of the shoulder portion 406 is a perpendicular flange 408 that extends inward towards the carburetor 10.

As with the choke lever 90, the travel-limited choke arm 400 has a disengaged position and an engaged position. However, the distance the travel-limited choke arm 400 can travel towards the engaged position is dependent upon temperature. In the disengaged position, the travel-limited choke arm 400 only covers a small portion of the inlet 31 to the air passage 30. In addition, the stem 115, which is connected to the transfer diaphragm 120, is in a fully extended position, urged outward by the action of the spring 130 on the transfer diaphragm 120.

When the travel-limited choke arm 400 is rotated counterclockwise away from the disengaged position, the travel-limited choke arm 400 will reach a point shown in FIG. 12 wherein the perpendicular flange 408 is in contact with the stem 115 and substantially all of the teardrop-shaped opening 402 will overlie the air passage inlet 31. If the travel-limited choke arm 400 is rotated counterclockwise beyond this point, the perpendicular flange 408 will depress the stem 115 and the narrow portion of the teardrop-shaped opening 402 will move away from the inlet 31, reducing the area of the teardrop-shaped opening 402 overlying the inlet 31. The farther the counterclockwise rotation, the greater the depression of the stem 115 and the greater the reduction in the overlying area of the teardrop-shaped opening 402.

As the depression of the stem 115 increases, the amount of fuel injected into the air passage 30 increases. As the overlying area of the teardrop-shaped opening 402 decreases, the vacuum in the air passage 30 created by the cranking of the engine increases. Accordingly, fuel delivery to the air passage 30 increases as the travel-limited choke arm 400 is rotated counterclockwise. A cam 412 (better shown in FIGS. 13 & 14) and a thermal spring 410 limit the counterclockwise travel of the travel-limited choke arm 400 based upon temperature. The colder the temperature, the farther the travel-limited choke arm 400 can be moved in the counterclockwise direction. In this manner the amount of fuel delivered to the air passage 30 during engine start-up is increased as the temperature decreases.

The cam 412 is rotatably mounted to the carburetor housing 20 through an eccentric axis 413. Since the axis 413 is eccentric, a portion of the cam 412 projects out farther from the axis 413 than the rest of the cam 412 The axis 413 is positioned below the semi-arcuate end 405 and to a side of the leg portion 411. The thermal spring 410 is connected to the cam 412 and controls the rotation of the cam 412. The thermal spring 410 is composed of two types of metal having different expansion ratios. The difference in expansion ratios causes the thermal spring 410 to change shape and thereby rotate the cam 412.

Figure 14:
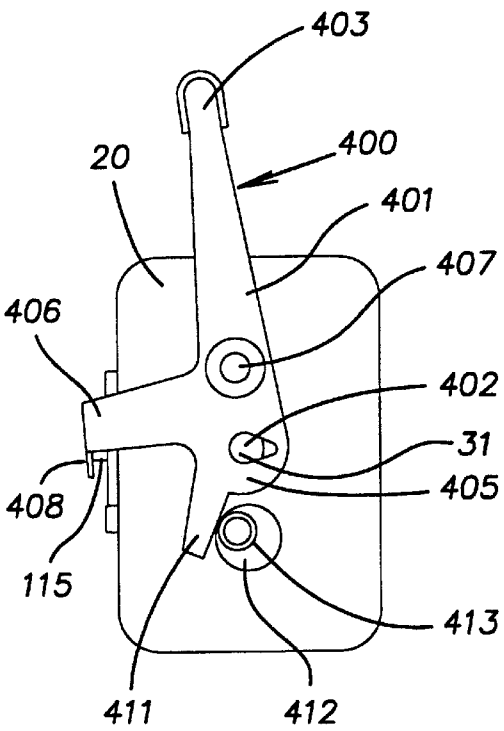
FIG. 14 shows a portion of the embodiment of FIGS. 12 and 13 having the travel-limited choke arm, wherein the ambient air is at a minimum temperature.
Figure 13:
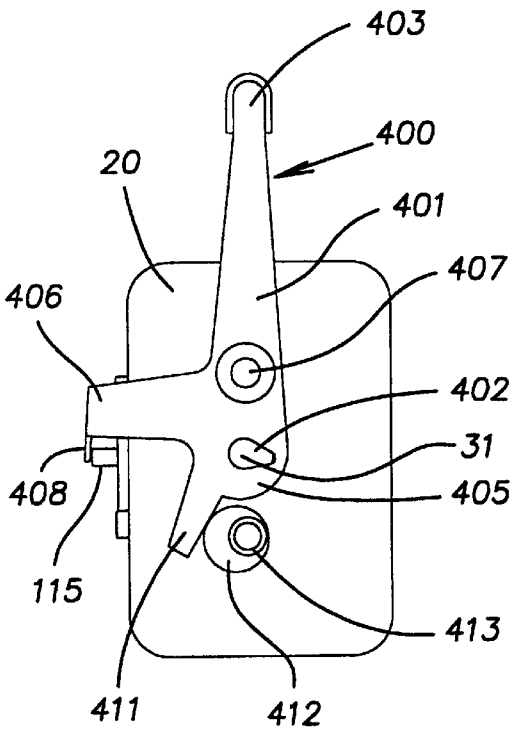
FIG. 13 shows a portion of the embodiment of FIG. 12 having the travel-limited choke arm, wherein the ambient air is at a maximum temperature.

Referring now to FIG. 13, the travel-limited choke arm 400 is shown at the maximum temperature. The thermal spring 410 is not shown in order to provide a better view of the cam 412. The thermal spring 410 (shown in FIG. 12) has rotated the cam 412 so that the far portion of the cam 412 is directed towards the leg portion 411. In this position, the cam 412 blocks the travel-limited choke arm 400 at a point where the stem 115 is only partially depressed and the overlying area of the teardrop-shaped opening 402 is only slightly reduced. As the temperature decreases, the thermal spring 410 moves the far portion of the cam 412 until the minimum temperature is reached. Referring now to FIG. 14, the travel-limited choke arm 400 is shown at the minimum temperature. The thermal spring 410 has rotated the cam 412 so that the far portion of the cam 412 is directed away from the leg portion 411. In this position, the cam 412 blocks the travel-limited choke arm 400 at a point where the stem 115 is fully depressed and the overlying area of the teardrop-shaped opening 402 has been noticeably reduced. Thus, at the minimum temperature, the travel-limited choke arm 400 is in the engaged position.

It will be appreciated that the foregoing embodiments of the present invention may undergo a number of modifications without departing from the scope of the present invention. For example an apparatus may be added for automatically moving the choke lever 90 (or compensating choke arm 350 or travel-limited choke arm 400) from the engaged position to the disengaged position after an engine start. This apparatus could be activated by a thermal switch or by pulses from the running engine. In addition, a resilient bulb or a piston could be used as the transfer device 100. Also, the transfer chamber 110 could be filled with a separate fuel pump It is to be understood that the description of the preferred embodiments are intended to be only illustrative, rather than exhaustive, of the present invention. Those of ordinary skill will be able to make certain additions, deletions, and/or modifications to the embodiments of the disclosed subject matter without departing from the spirit of the invention or its scope, as defined by the appended claims.

What is claimed is:

1. A carburetor for an internal combustion engine, said carburetor comprising:

a housing defining an air passage for air flow communication with the engine;

a fuel pump;

a fuel supply circuit having orifices that open into the air passage;

a fuel delivery device connected to the fuel supply circuit, said fuel delivery device including a flexible diaphragm, which at least partially defines a fuel chamber for receiving fuel from the fuel pump, said fuel delivery device being operable in response to air flow through the air passage to deliver fuel from the fuel chamber to the air passage through the fuel supply circuit; and a fuel injection device connected to the fuel supply circuit, said fuel injection device including a movable member which at least partially defines an injection chamber for receiving fuel, wherein said movable member is movable from a first position to a second position to eject fuel from the injection chamber, thereby injecting fuel into the air passage through the fuel supply circuit, said fuel being free to move through the air passage to the engine.

2. The carburetor of claim 1 further comprising a valve passage fitted with one-way valves, said valve passage interconnecting the fuel delivery device, the fuel injection device and the fuel supply circuit so as to permit fuel from the fuel chamber to travel to the air passage and to the injection chamber while preventing fuel from the injection chamber from travelling to the fuel chamber, said valve passage permitting fuel from the injection chamber to travel into the air passage when the movable member is displaced from the first position to the second position.

3. The carburetor of claim 1, wherein the fuel delivery device includes a flexible diaphragm that at least partially defines the fuel chamber.

4. The carburetor of claim 3, further comprising:

a fuel valve connected between the fuel pump and the fuel delivery device, said fuel valve being operable to open in response to a negative pressure in the fuel chamber, thereby supplying fuel to the fuel chamber; and a purging device for creating the negative pressure in the fuel chamber when the engine is inactive so as to provide fuel to the metering chamber.

5. The carburetor of claim 4, wherein the purging device is adapted to allow fuel from the fuel chamber to flow into the purging device, while preventing fuel in the purging device from flowing into fuel chamber.

6. The fuel delivery system of claim 1, further comprising a transfer passage connecting the injection chamber to the metering chamber, said transfer passage permitting fuel from the injection chamber to travel into the metering chamber, wherein movement of the movable member toward the opposing wall ejects the predetermined volume of fuel from the injection chamber into the metering chamber, thereby forcing fuel to exit the metering chamber and enter the air passage through the fuel supply circuit.

7. A fuel delivery system for an internal combustion engine, said fuel delivery system comprising:

a housing defining an air passage through which air is drawn when the engine is running, said air passage having an inlet and an outlet, said outlet being in communication with the engine;

a metering device including a flexible diaphragm, said diaphragm at least partially defining a metering chamber;

a fuel valve for supplying fuel to the metering chamber in response to a negative pressure in the metering chamber;

a fuel supply circuit connected to the metering device and having orifices that open into the air passage;

a purging device for creating the negative pressure in the metering chamber when the engine is inactive so as to provide fuel to the metering chamber; and a fuel injection device connected between the metering device and the purging device, said fuel injection device having a movable member and an opposing wall which cooperate to define an injection chamber, wherein movement of the movable member toward the opposing wall ejects a predetermined volume of fuel from the injection chamber, thereby injecting fuel into the air passage.

8. The fuel delivery system of claim 7, further comprising a valve passage fitted with one-way valves, said valve passage interconnecting the metering device, the fuel injection device and the fuel supply circuit so as to permit fuel from the metering chamber to travel to the air passage and to the injection chamber while preventing fuel from the injection chamber from travelling to the metering chamber, wherein movement of the movable member toward the opposing wall ejects the predetermined volume of fuel from the injection chamber into the air passage through the valve passage and the fuel supply circuit.

9. The fuel delivery system of claim 7, further comprising a transfer passage connecting the injection chamber to the metering chamber, said transfer passage permitting fuel from the injection chamber to travel into the metering chamber, wherein movement of the movable member toward the opposing wall ejects the predetermined volume of fuel from the injection chamber into the metering chamber, thereby forcing fuel to exit the metering chamber and enter the air passage through the fuel supply circuit.

10. The fuel delivery system of claim 7, further comprising:

an outlet line;

a fuel tank connected to the purging device by the outlet line; and an inlet line connecting the fuel injection device to the purging device.

11. The fuel delivery system of claim 10, wherein the purging device comprises a resilient domed cap secured to a housing so as to form a pump chamber, said housing having an inlet fitted with a one-way valve and connected to the inlet line, and an outlet fitted with a one-way valve and connected to the outlet line, said one-way valves permitting fluid to flow from the injection chamber into the pump chamber, while preventing fluid in the pump chamber from flowing into the injection chamber.

12. A method for preparing an internal combustion engine for starting, said engine having a carburetor including a fuel injection device having a movable member defining an injection chamber and an air passage connected to a metering chamber by a fuel supply circuit, said air passage having a throttle valve disposed therein, said method comprising the steps of:

introducing fuel into the metering chamber;

restricting air flow through the air passage;

introducing fuel into the injection chamber from the metering chamber so as to fill the injection chamber with a predetermined volume of fuel; and ejecting the predetermined volume of fuel from the injection chamber by movement of the movable member, thereby injecting fuel into the air passage through the fuel supply circuit.

13. The method of claim 12 further comprising the step of opening the throttle valve.

14. The method of claim 13 wherein the steps of restricting air flow, ejecting fuel from the injection chamber and opening the throttle valve are performed simultaneously.

* * * * *

UNITED STATES PATENT AND TRADEMARK OFFICE

CERTIFICATE OF CORRECTION

PATENT NO. : 6,079,697
DATED : June 27, 2000
INVENTOR(S) : Tuggle et al.

It is certified that error appears in the above-identified patent and that said Letters Patent is hereby corrected as shown below:

Title page,
References Cited, Section [56], Foreign Patent Documents, delete "324255", and insert -- 3-242455 --.

Column 19,
Line 2, after "412", insert -- . --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*